US009841155B2

(12) United States Patent
Rao et al.

(10) Patent No.: US 9,841,155 B2
(45) Date of Patent: Dec. 12, 2017

(54) LED LAMP RETROFIT SYSTEM, KIT, AND METHOD

(71) Applicant: Litetronics International, Inc., Harvey, IL (US)

(72) Inventors: Raghu Rao, Romeoville, IL (US); Robert Sorensen, Harvey, IL (US)

(73) Assignee: Litetronics International, Inc., Bedford Park, IL (US)

( * ) Notice: Subject to any disclaimer, the term of this patent is extended or adjusted under 35 U.S.C. 154(b) by 384 days.

(21) Appl. No.: 14/622,006

(22) Filed: Feb. 13, 2015

(65) Prior Publication Data

US 2016/0069542 A1 Mar. 10, 2016

Related U.S. Application Data

(63) Continuation-in-part of application No. 14/479,903, filed on Sep. 8, 2014, now Pat. No. 8,960,951.

(51) Int. Cl.

| | |
|---|---|
| ***F21S 4/00*** | (2016.01) |
| ***F21S 9/02*** | (2006.01) |
| ***F21K 9/27*** | (2016.01) |
| ***F21S 4/28*** | (2016.01) |
| *F21W 131/40* | (2006.01) |
| *F21Y 113/00* | (2016.01) |
| *F21Y 103/10* | (2016.01) |
| *F21Y 115/10* | (2016.01) |

(52) U.S. Cl.

CPC ..... *F21S 9/022* (2013.01); *F21K 9/27* (2016.08); *F21S 4/28* (2016.01); *F21W 2131/40* (2013.01); *F21Y 2103/10* (2016.08); *F21Y 2113/00* (2013.01); *F21Y 2115/10* (2016.08)

(58) Field of Classification Search

CPC .... F21K 9/27; F21K 9/23; F21S 4/008; F21S 9/022; F21W 2131/40; F21Y 2103/10; F21Y 2103/00; F21Y 2115/10

See application file for complete search history.

(56) References Cited

U.S. PATENT DOCUMENTS 6,126,028 A * 10/2000 Buckley ..... H02G 3/14 220/230

FOREIGN PATENT DOCUMENTS

CN 203760977 * 8/2014 ..... H02G 3/18

* cited by examiner

*Primary Examiner* — Ali Alavi

(74) *Attorney, Agent, or Firm* — Witters & Associates; Steve Witters

(57) ABSTRACT

An LED lamp retrofit system, kit, and method is presently disclosed. The LED retrofit system comprises at least one longitudinally extending LED lamp having a length substantially greater than a width and open longitudinal ends. A first LED lamp support rail holds and covers a first open longitudinal end of each of the at least one longitudinally extending LED lamps and is configured to electrically connect each of the at least one longitudinally extending LED lamps to a power source. A second LED lamp support rail holds and covers a second open longitudinal end of each of the at least one longitudinally extending LED lamps held with the first LED lamp support rail. A system holder on each of the first and second LED lamp support rails is configured and disposed to hold the retrofit system to a portion of a lamp fixture being retrofitted.

19 Claims, 14 Drawing Sheets

LED LAMP RETROFIT SYSTEM, KIT, AND METHOD

CROSS-REFERENCE TO RELATED APPLICATIONS

This application claims the benefit of U.S. application Ser. No. 14/479,903, filed Sep. 8, 2014, entitled LED Lamp Retrofit System, Kit, and Method, which is hereby incorporated by reference in its entirety.

FIELD OF THE DISCLOSURE

This invention generally relates to light fixtures, and, more particularly, to an LED lamp retrofit system, kit, and method, such as an LED lamp retrofit system for fluorescent light fixtures.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Surface mount and recessed fluorescent light fixtures, such as strip and troffer light fixtures, have typically been installed to provide general lighting of large indoor spaces. For example, surface mount and recessed type fluorescent strip light fixtures may include stem and pendant mounted suspended variations as well as those fixtures mounted directly to a ceiling or in the ceiling.

Typically, such strip fixtures include a channel in the form of an inverted trough or troffer, with the channel being attached to or recessed in the ceiling. Lamp holders or sockets are attached to the channel or troffer. A ballast is attached within the channel and wiring attaches the ballast to the lamp holders. Power is supplied to the ballast by wiring brought into the channel through the top or end of the channel. A ballast cover is used to cover the ballast and wiring. Linear fluorescent lamps are then placed in the lamp holders for operation of the fixture. The lamps may be left bare or covered for providing light to the space below. Because of their low cost and utilitarian use, fluorescent strip light fixtures are currently installed in abundance. For example, typical uses include warehouses, retail stores, such as grocery, drug, and department stores, where the fixtures are commonly mounted in continuous rows.

Since the introduction of the fluorescent lamp at the 1939 World Fair, fluorescent lighting technology has greatly advanced. For example, over the years, lamp and ballast manufacturers have developed fluorescent lamp-ballast systems with improved efficiencies. More recently, light emitting diode (LED) lamps have been developed. An LED lamp is a solid-state lamp that uses LEDs as the source of light. An LED may comprise a conventional semiconductor light emitting diode or an organic or polymeric light emitting diode. LED lamps may have one or more advantages over fluorescent lamps, for example, LED lamps do not contain mercury, they may turn on more instantaneously, they may have a longer service life, and they may have a greater efficiency.

It may be desired to provide advantages of LEDs to existing fluorescent light fixtures. However, for existing installations, implementation of the newer technology may require either replacing the individual fixture components (ballast, lamp holders, wiring, and lamps) or replacing the fixtures all together. Both processes may be time consuming and labor intensive, requiring 30 minutes or so for each fixture retrofit or replacement. Further, current retrofit processes or systems may require closing down sections of a store during installation, increasing the impact of the time and effort required to retrofit or replace the old fixtures. Thus, there is a need for LED retrofit systems, kits, and methods for fluorescent light fixtures that may be installed with a minimum of time and labor.

SUMMARY

In at least one aspect of the present disclosure, an LED retrofit system is provided. The LED retrofit system comprises at least one longitudinally extending LED lamp having a length substantially greater than a width and open longitudinal ends. A first LED lamp support rail holds and covers a first open longitudinal end of each of the at least one longitudinally extending LED lamps. The first LED lamp support rail is configured to electrically connect each of the at least one longitudinally extending LED lamps to a power source. A second LED lamp support rail holds and covers a second open longitudinal end of each of the at least one longitudinally extending LED lamps held with the first LED lamp support rail. Each of the first and second LED lamp support rails have a system holder configured and disposed to hold the retrofit system to a portion of a lamp fixture being retrofitted.

In another aspect of the present disclosure, an LED retrofit kit is provided. The LED retrofit kit comprises a first LED lamp support rail configured to hold and cover a first longitudinal open end of at least one longitudinally extending LED lamp and to electrically connect each of the at least one longitudinally extending LED lamps to a power source. A second LED lamp support rail is configured to hold and cover a second longitudinal open end of each of the at least one longitudinally extending LED lamps held with the first LED lamp support rail. At least one magnet is on the first LED lamp support rail and at least one magnet is on the second LED support rail, wherein the magnets are configured and disposed to hold the retrofit kit to a portion of a lamp fixture being retrofitted.

In a further aspect of the present disclosure, a method of retrofitting a fluorescent lamp fixture with at least one LED lamp is provided. The method comprising the steps of: turning off the power to the fluorescent lamp fixture being retrofitted; accessing the fluorescent lamps in fluorescent lamp fixture; removing the fluorescent lamps from the fluorescent lamp fixture; removing a ballast cover from the fluorescent lamp fixture; cutting wires leading to and from a ballast in the fluorescent lamp fixture; removing the ballast from the fluorescent lamp fixture; attaching an electrical connector to the cut wires leading to the removed ballast; assembling a retrofit system by performing the steps of: placing a first LED lamp support rail on a substantially flat surface; placing a second LED lamp support rail on the substantially flat surface and in a substantially parallel orientation with the first LED lamp support rail; electrically connecting and holding a first end of at least one longitudinally extending LED lamp, with the first LED lamp support rail; and connecting and holding a second end of at least one longitudinally extending LED lamp, with the second LED lamp support rail; magnetically attaching the assembled retrofit system to a central portion of a troffer box cavity of the fluorescent lamp fixture being retrofitted; making an electrical junction between the first end of each of the at least one longitudinally extending LED lamps and the cut wires extending into the troffer box; and turning on the power to the LED lamp retrofitted fluorescent lamp fixture.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

DETAILED DESCRIPTION

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

Figure 1:
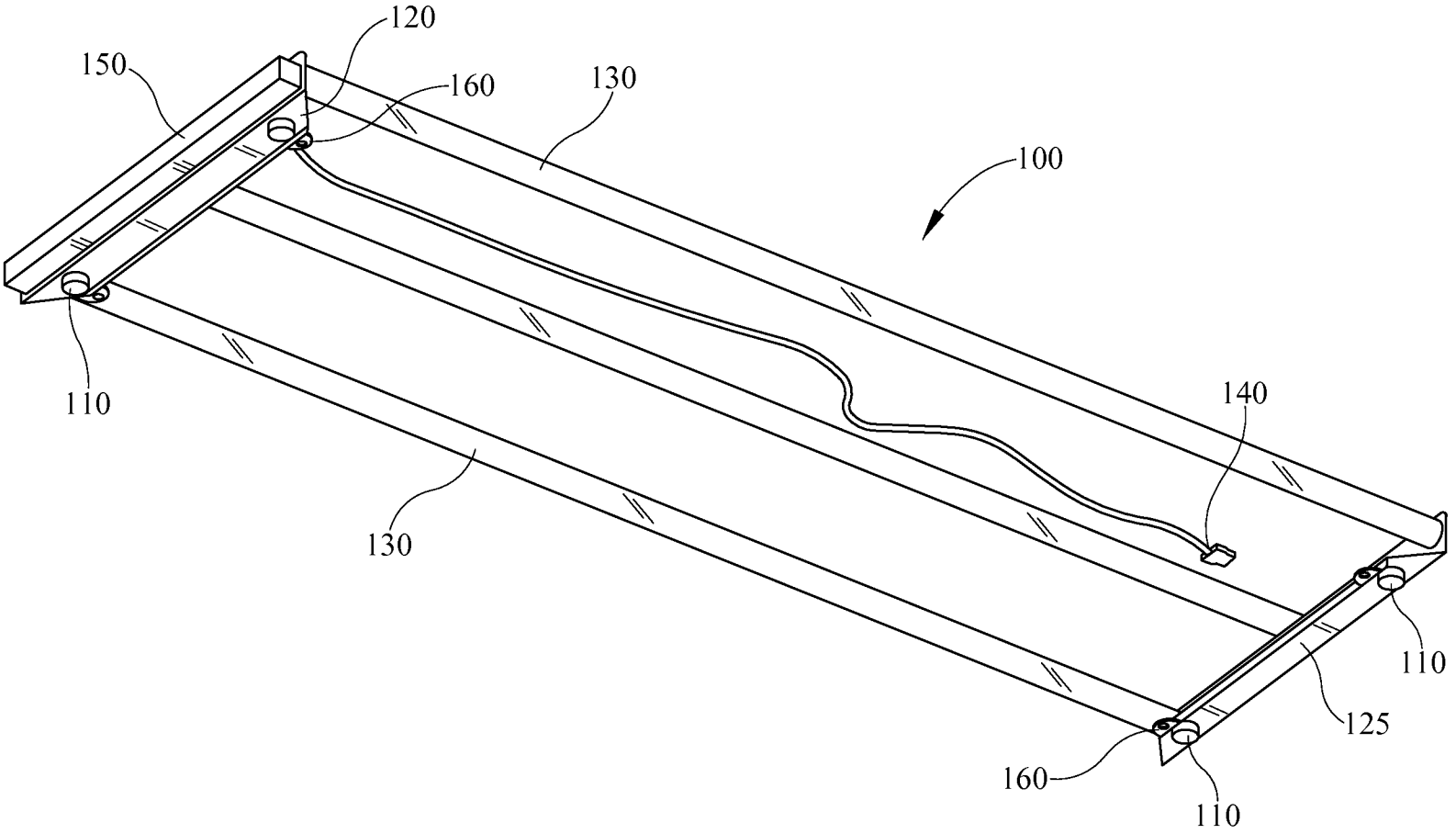
FIG. 1 is an upper perspective view of an LED retrofit system of the present disclosure.
Figure 2:
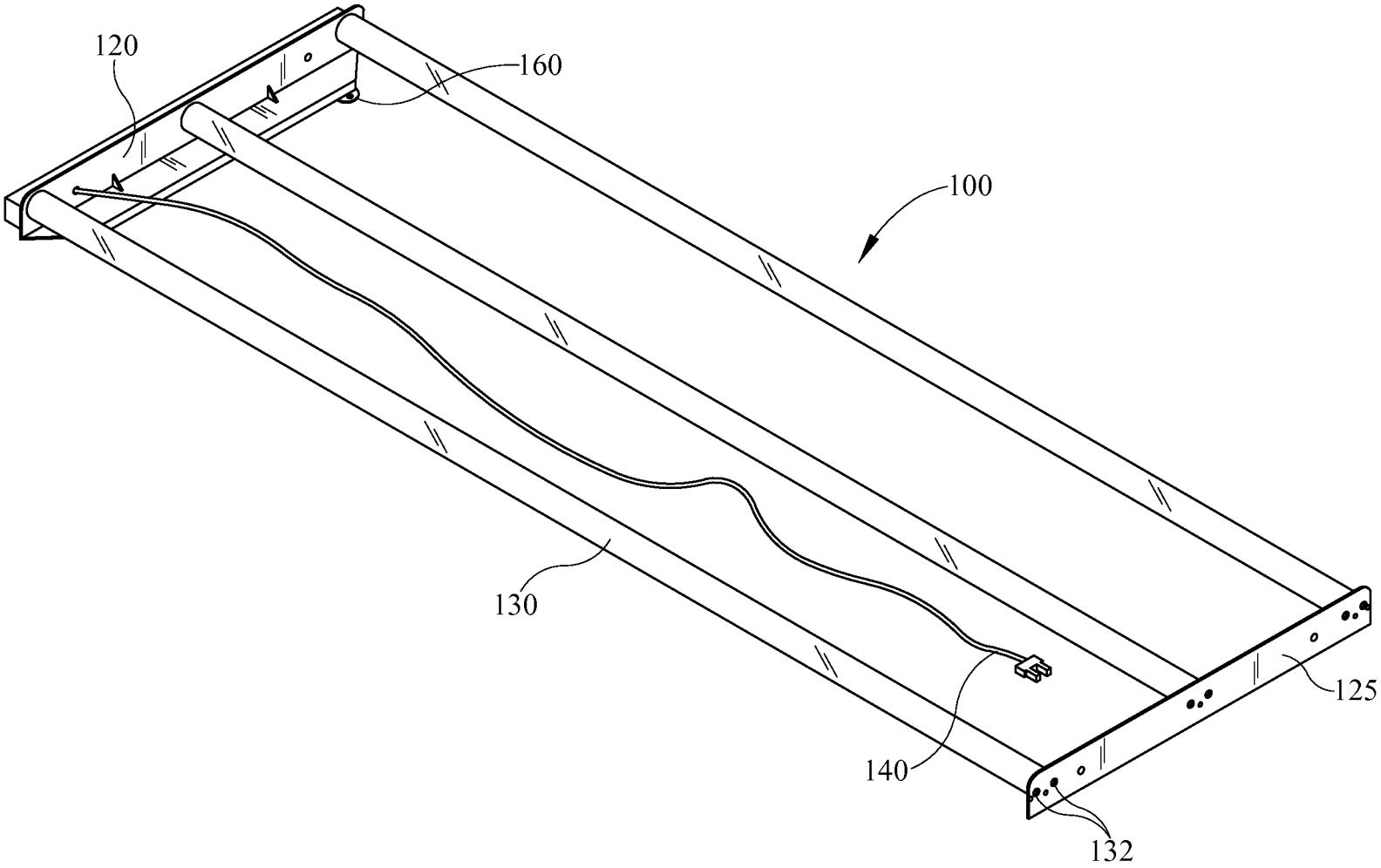
FIG. 2 is a lower perspective view of the LED retrofit system shown in FIG. 1.

FIGS. 1 and 2 show upper and lower perspective views of LED retrofit system 100 of the present disclosure. LED retrofit system 100 comprises three longitudinally extending LED lamps 130, each having a length substantially greater than a width. Each LED lamp 130 has each of its longitudinal ends, 137 shown in FIG. 4, open or void of any covering. A first LED lamp support rail 120 is shown holding and covering a first open longitudinal end of each of the three longitudinally extending LED lamps 130. First LED lamp support rail 120 is configured to electrically connect each longitudinally extending LED lamp 130 to a power source with electrical wire and connector 140. Electric wire cover 150 may be provided with first support rail 120 to cover wires and any electronics for electrically connecting each longitudinally extending LED lamp 130 with electrical wire and connector 140. Second LED lamp support rail 125 is holding and covering a second open longitudinal end of each longitudinally extending LED lamp 130, held with first LED lamp support rail 120. Each longitudinal extending LED lamp 130 may have each of its open longitudinal ends connected with LED lamp support rails 120 and 125 with fasteners 132.

First and second LED lamp support rails 120 and 125 are configured and disposed to hold retrofit system 100 to a portion of a lamp fixture being retrofitted. For example, first and second LED lamp support rails 120 and 125 may each have a system holder. The system holder may comprise at least one mechanical holding device and/or at least one magnetic holding device configured and disposed to hold retrofit system 100 to a portion of a lamp fixture being retrofitted, for example a central portion of a troffer. In at least one aspect of the present disclosure, LED retrofit system 100 comprises at least one magnet 110 on first LED lamp support rail 120 and at least one magnet 110 on second LED lamp support rail 125. Magnets 110 are configured and disposed to hold retrofit system 100 to a portion of a lamp fixture being retrofitted. In at least one other aspect of the present disclosure, LED retrofit system 100 has mechanical holding devices 160. Mechanical holding device 160 may have an aperture 161 in a portion of each first and second support rail, 120 and 125. The portion of the first and second support rails 120 and 125 having aperture 161 may be disposed in a plane parallel to a plane of each longitudinally extending lamp 130. In at least one aspect of retrofit system 100, both mechanical and magnetic system holders may be provided.

Figure 3:
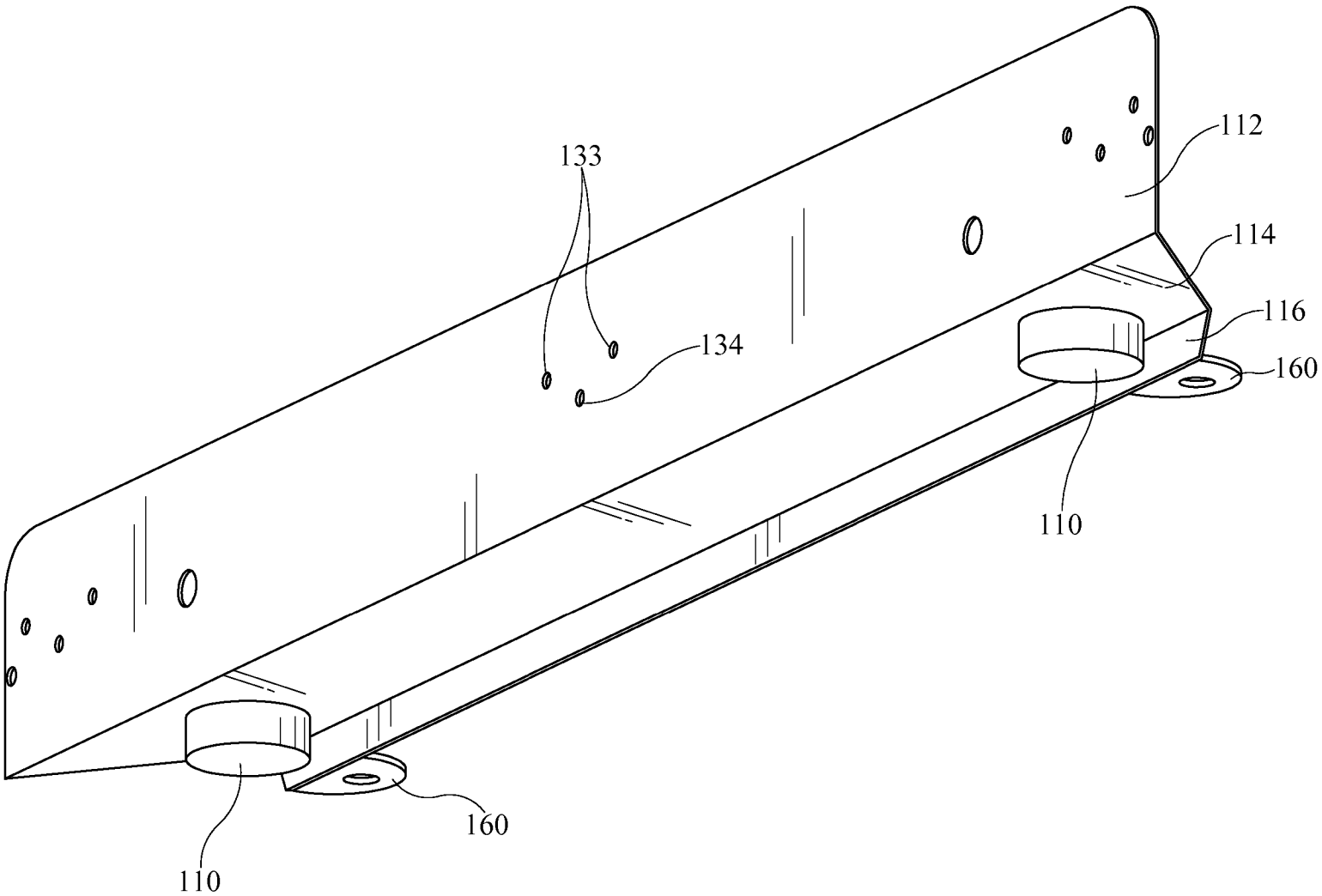
FIG. 3 is an upper perspective view of an LED lamp support rail of the LED retrofit system shown in FIG. 1.
Figure 4:
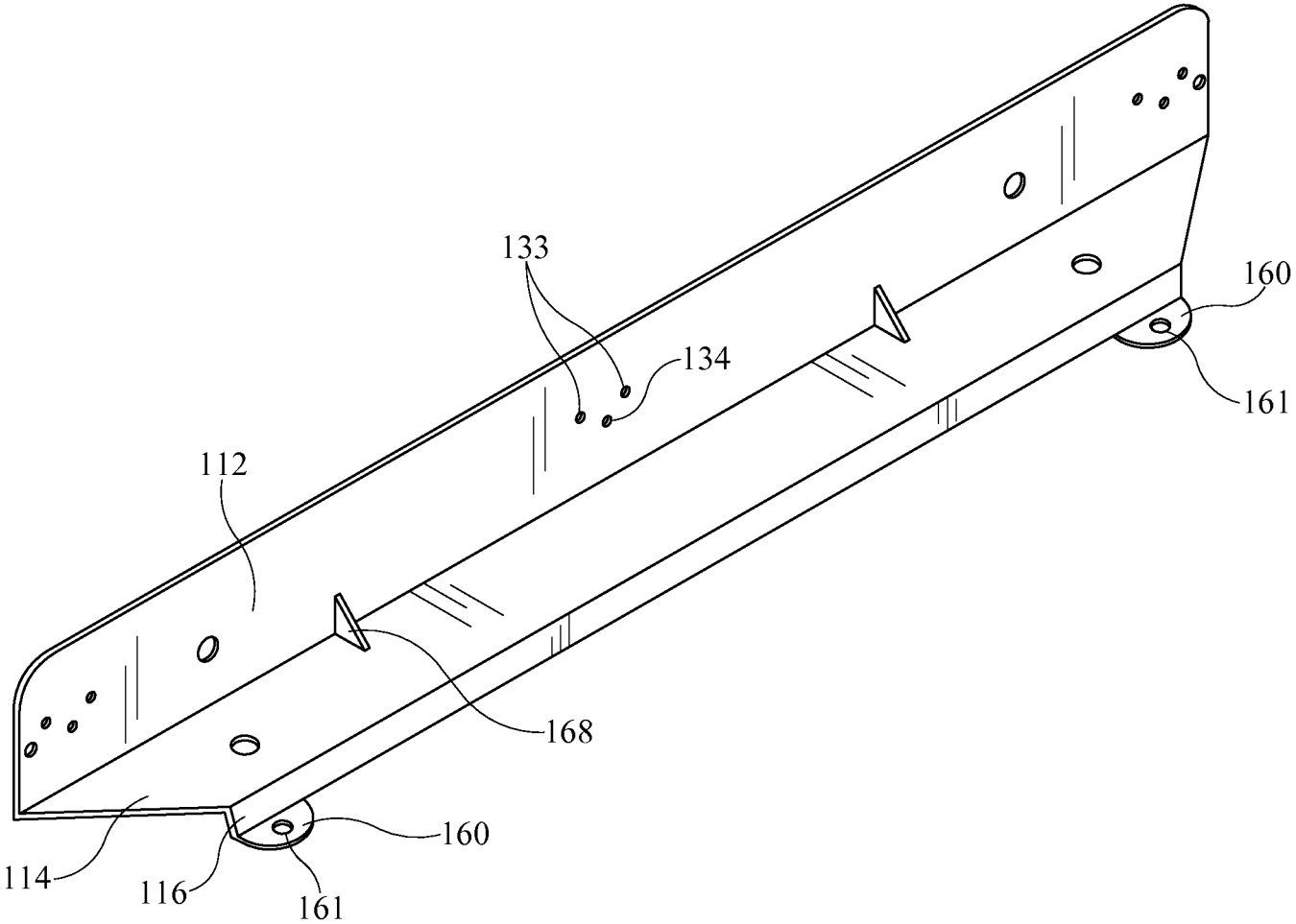
FIG. 4 is a lower perspective view of an LED lamp support rail of the LED retrofit system shown in FIG. 1.

FIGS. 3 and 4 show upper and lower perspective views of at least aspect of an LED lamp support rail 120, 125, or both, of LED retrofit system 100. Upon attaching LED retrofit system 100 to a portion of a fluorescent light fixture being retrofitted, LED lamp holder and end cover 112 extends downward. Fasteners 132, shown in FIG. 2, may be extended through fastener apertures 133 and fasten open longitudinal ends of LED lamps 130, holding longitudinal extending LED lamps to the LED support rails. Wires leading to each of the longitudinal extending LED lamp 130 may extend through wiring apertures 134.

LED lamp support rail fastening leg 114 may extend substantially perpendicular from lamp holder and end cover 112. Supports 168 may extend between LED lamp support rail fastening leg 114 and lamp holder and end cover 112 to provide support in maintaining a substantially perpendicular extension of LED lamp support rail fastening leg 114 from lamp holder and end cover 112. Magnets 110 may be disposed with or fastened to LED lamp support rail fastening leg 114. Alternatively, LED lamp support rail fastening leg 114 may have apertures disposed to provide mechanical fastening to a troffer of a fluorescent lamp fixture being retrofitted.

LED lamp support rail extension 116 may extend from LED lamp support rail fastening leg 114 and may be configured to dispose a mechanical holding device. For example, a mechanical holding device 160 may have a tab extending in a plane substantially parallel with an outer surface of magnets 110 and may have a mechanical holding aperture 161 configured to receive a fastener, such as a screw, for mechanically holding LED retrofit system 100 to a fluorescent light fixture being retrofitted.

Figure 5:
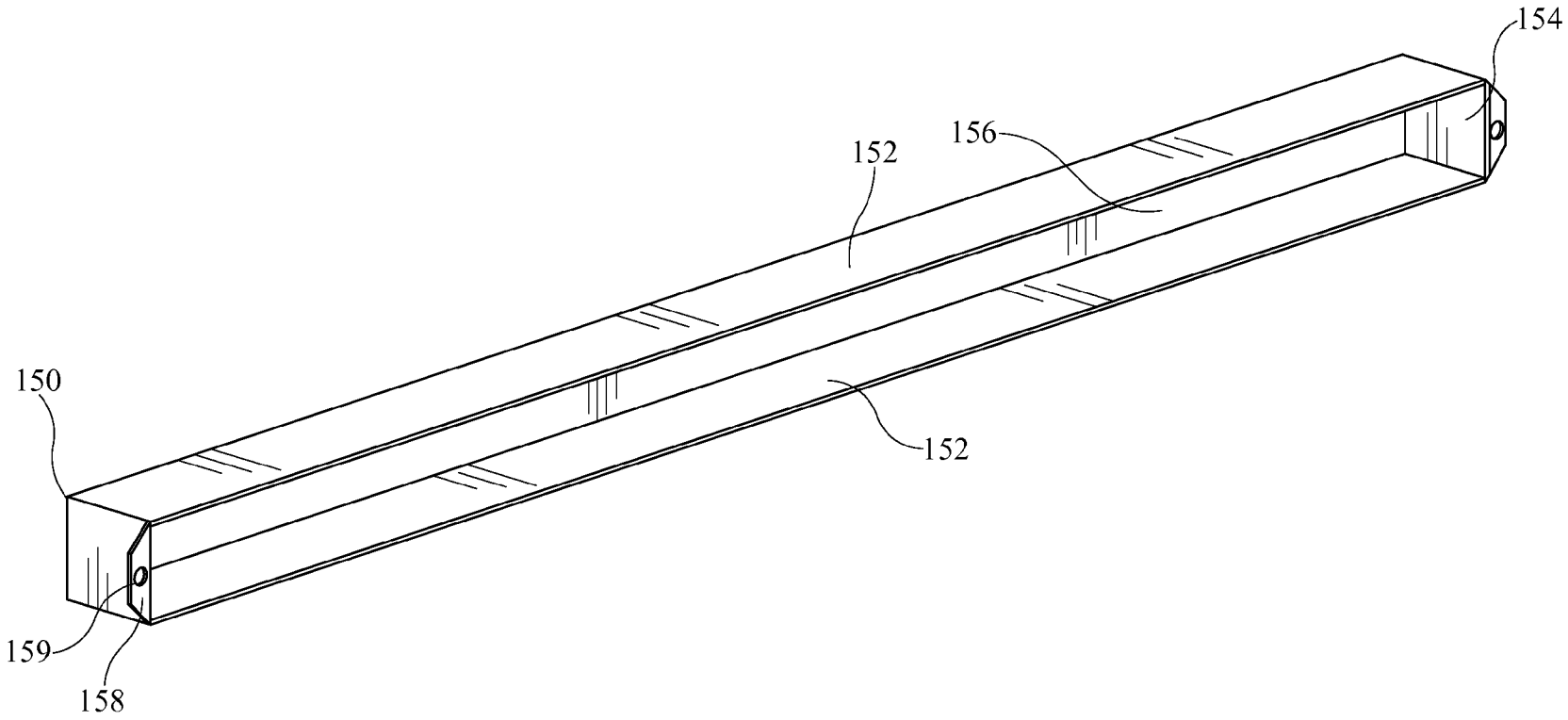
FIG. 5 is a perspective view of a wiring cover of the LED retrofit system shown in FIG. 1.

FIG. 5 shows a perspective view of a wiring cover 150 of LED retrofit system 100. Wiring cover 150 is configured to cover wires extending to each longitudinally extending LED lamp 130 from a power source, electrical wire and connector 140, or the existing electrical wiring in a lamp fixture being retrofitted. Wiring cover 150 has sidewalls 152 depending from top wall 156. End walls 154 extend between sidewalls 152 and top wall 156. Electrical wire cover holders 158 may extend outwardly from end walls 154 and may have an aperture 159 therein. A fastener, not shown, may be extended through apertures 159 and fastened with first LED support rail 120, fastening wiring cover 150 to lamp holder and end cover 112, of first LED support rail 120, as shown in FIG. 1.

Figure 6:
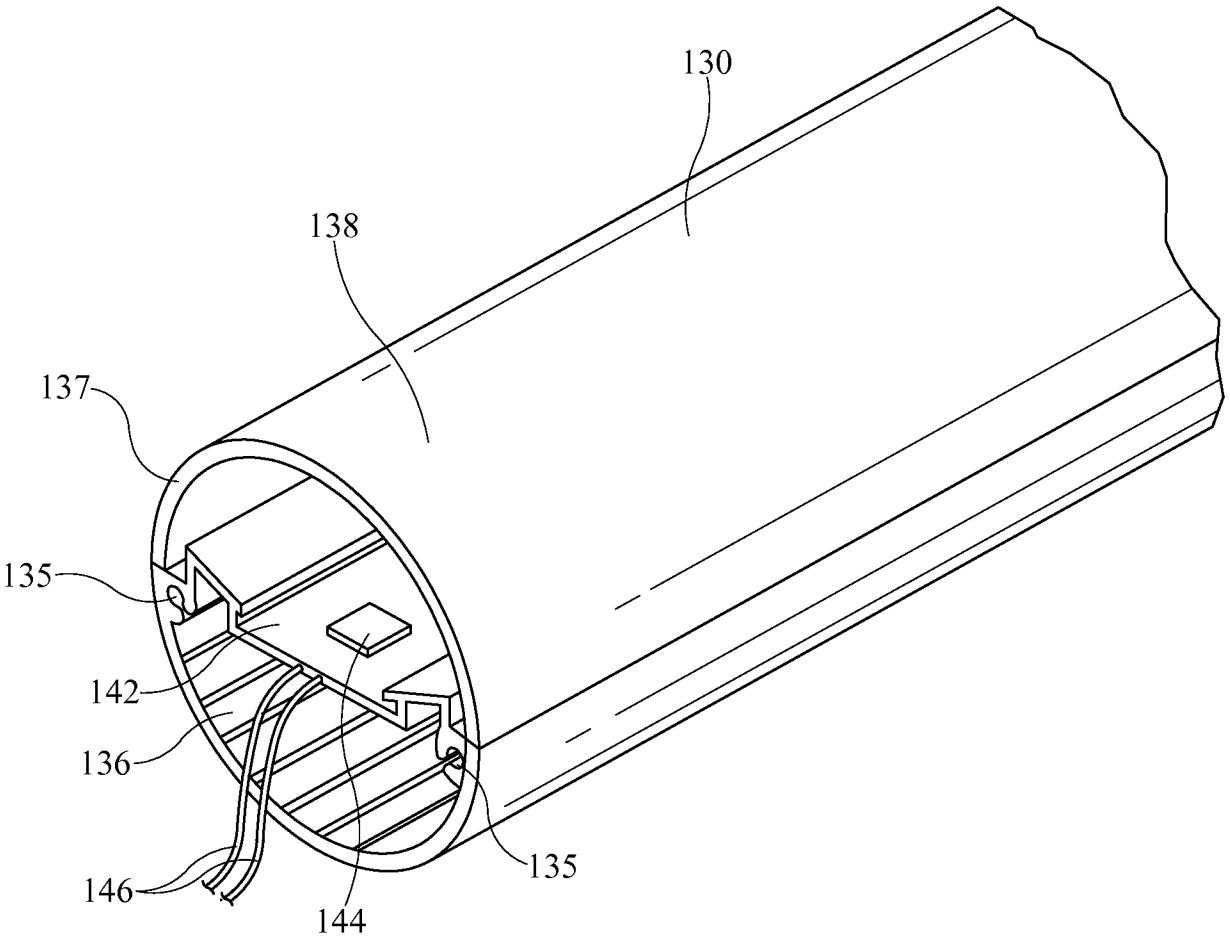
FIG. 6 is a perspective view of an open end portion of a longitudinally extending LED lamp of the present disclosure.

FIG. 6 shows an open longitudinal end 137 portion of longitudinally extending LED lamp 130. LED lamp 130 has female helical threads 135 configured and disposed for fastening with LED support rails 120 and 125. LED lamp 130 comprises a heat sink 136 and an LED lamp energy transmissible cover 138 joined together at longitudinally extending edges to form a tubular housing for LEDs 144. LED substrate 142 longitudinally extends LED lamp 130 and is disposed between heat sink 136 and LED lamp energy transmissible cover 138. An array of LEDs 144 are held on the side of LED substrate 142 facing LED lamp energy transmissible cover 138. For example, a string of LEDs may be disposed on LED substrate 142. In at least one aspect of the present disclosure, longitudinally extending LED lamp 130 has an optical and visual outlook substantially similar to a fluorescent lamp. LED power wires 146 extend from substrate 142 and are configured to extend through wiring aperture 134 in first LED lamp support rail 120.

Figure 7:
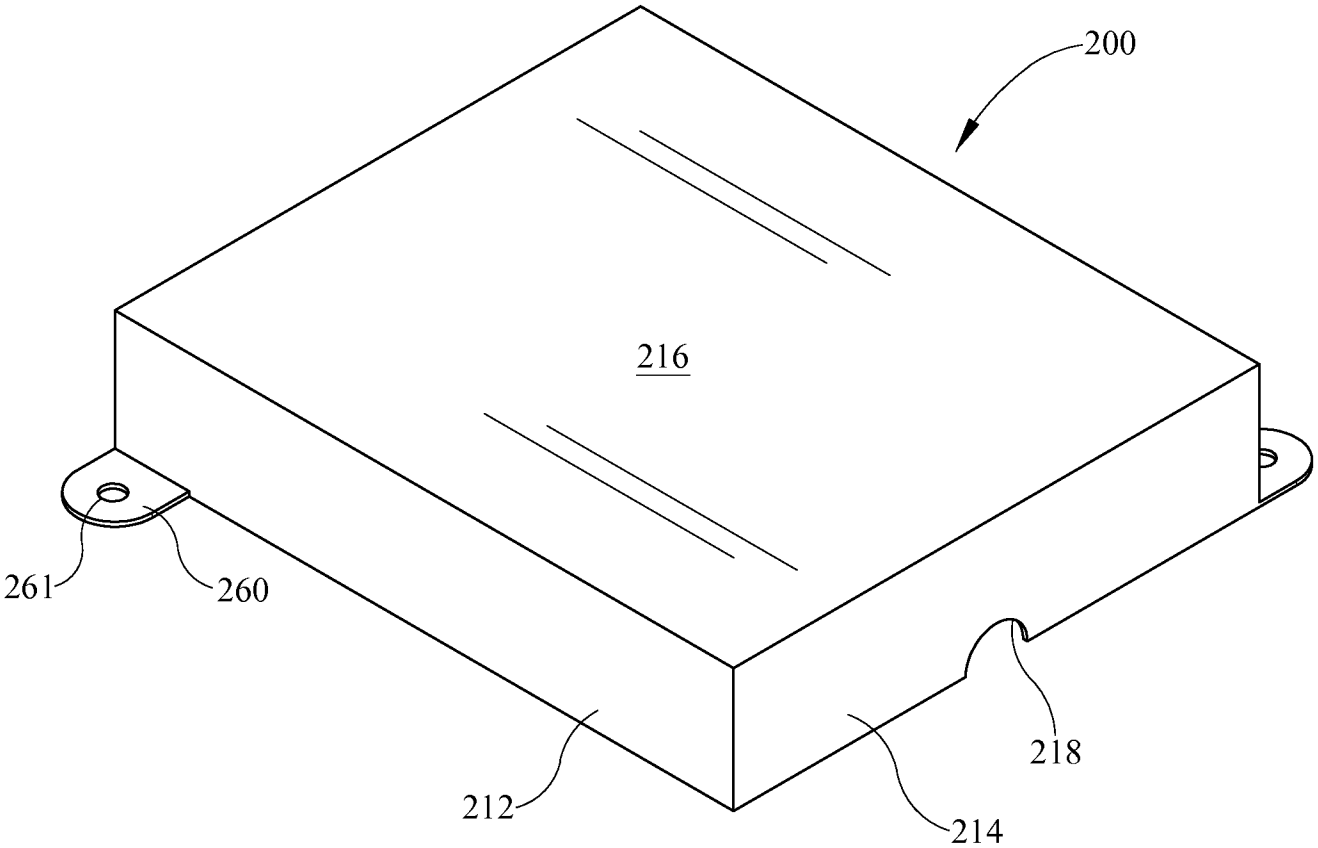
FIG. 7 is a lower perspective view of an electrical junction box of the present disclosure.
Figure 8:
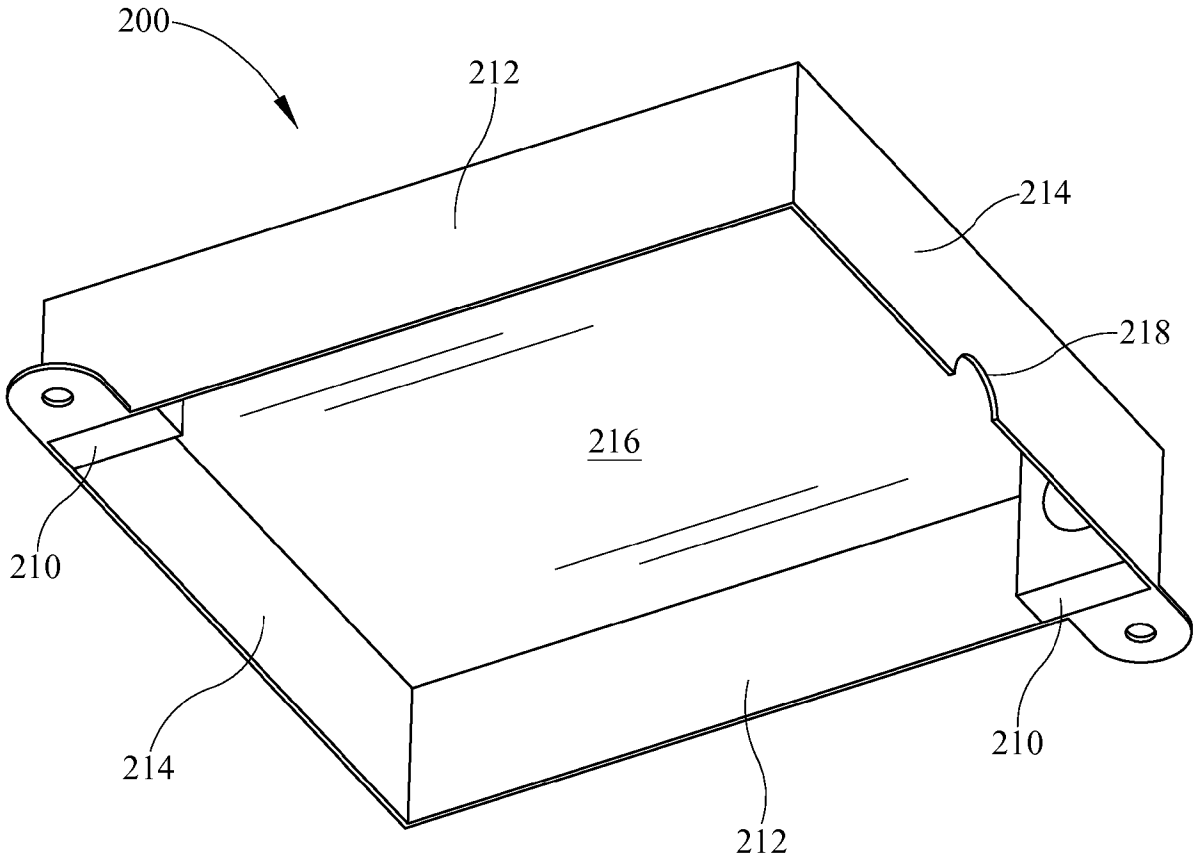
FIG. 8 is an upper perspective view of the electrical junction box shown in FIG. 7.
Figure 9:
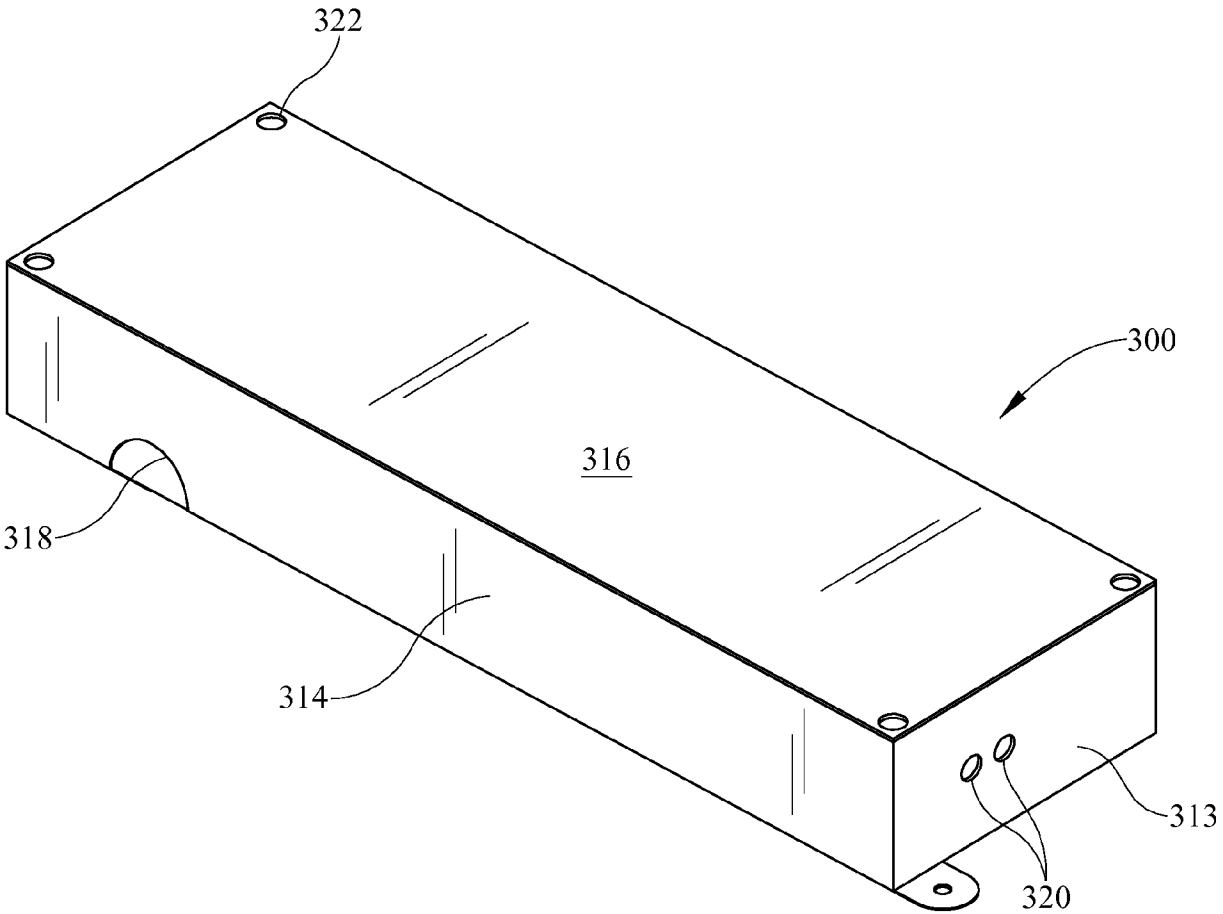
FIG. 9 is an upper perspective view of an emergency lamp module.
Figure 10:
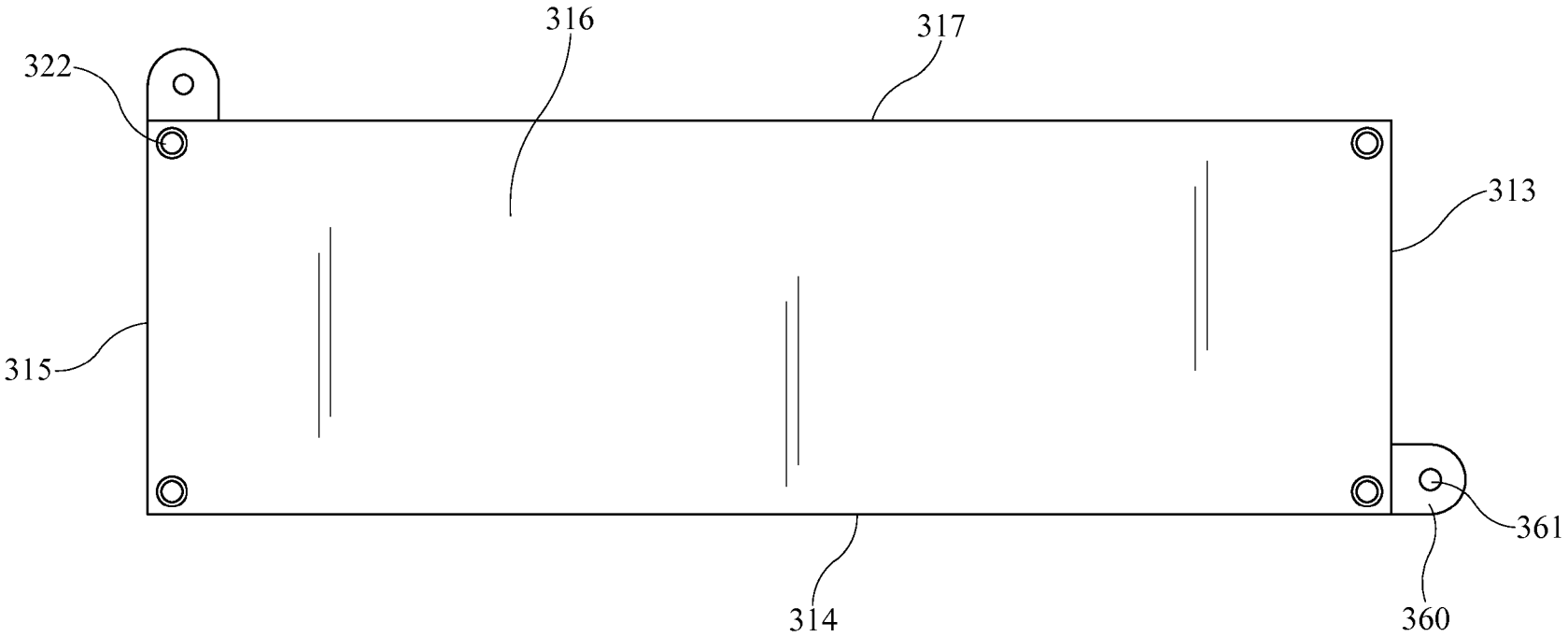
FIG. 10 is a top view of the emergency lamp module of FIG. 9.
Figure 11:
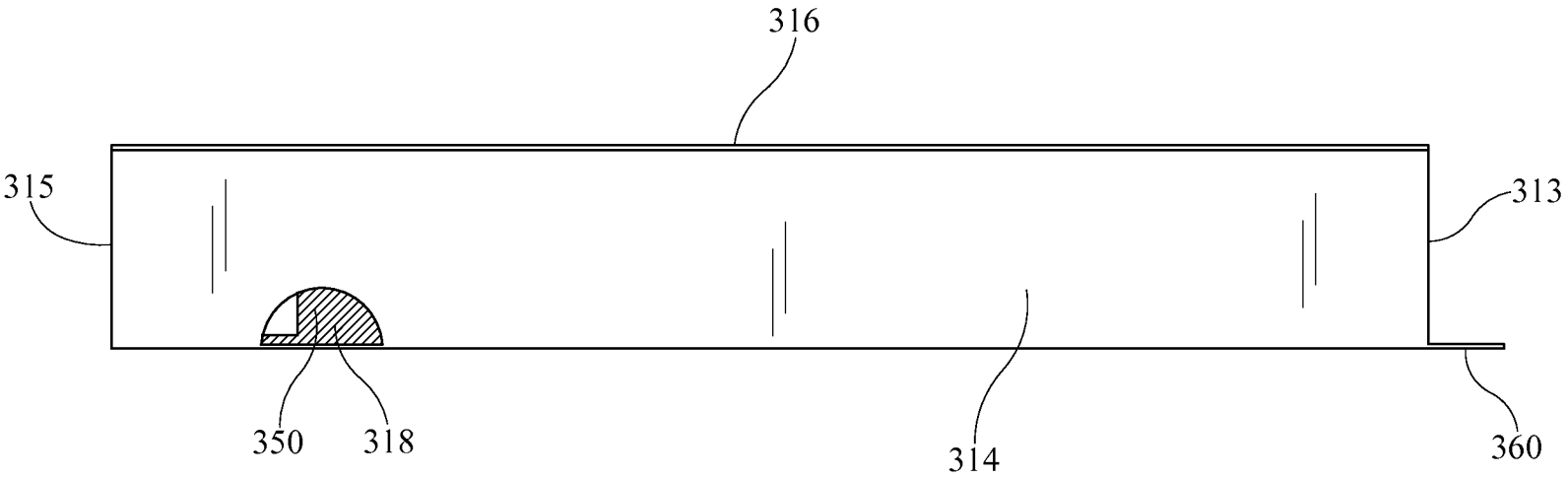
FIG. 11 is a front view of the emergency lamp module of FIG. 9.
Figure 12:
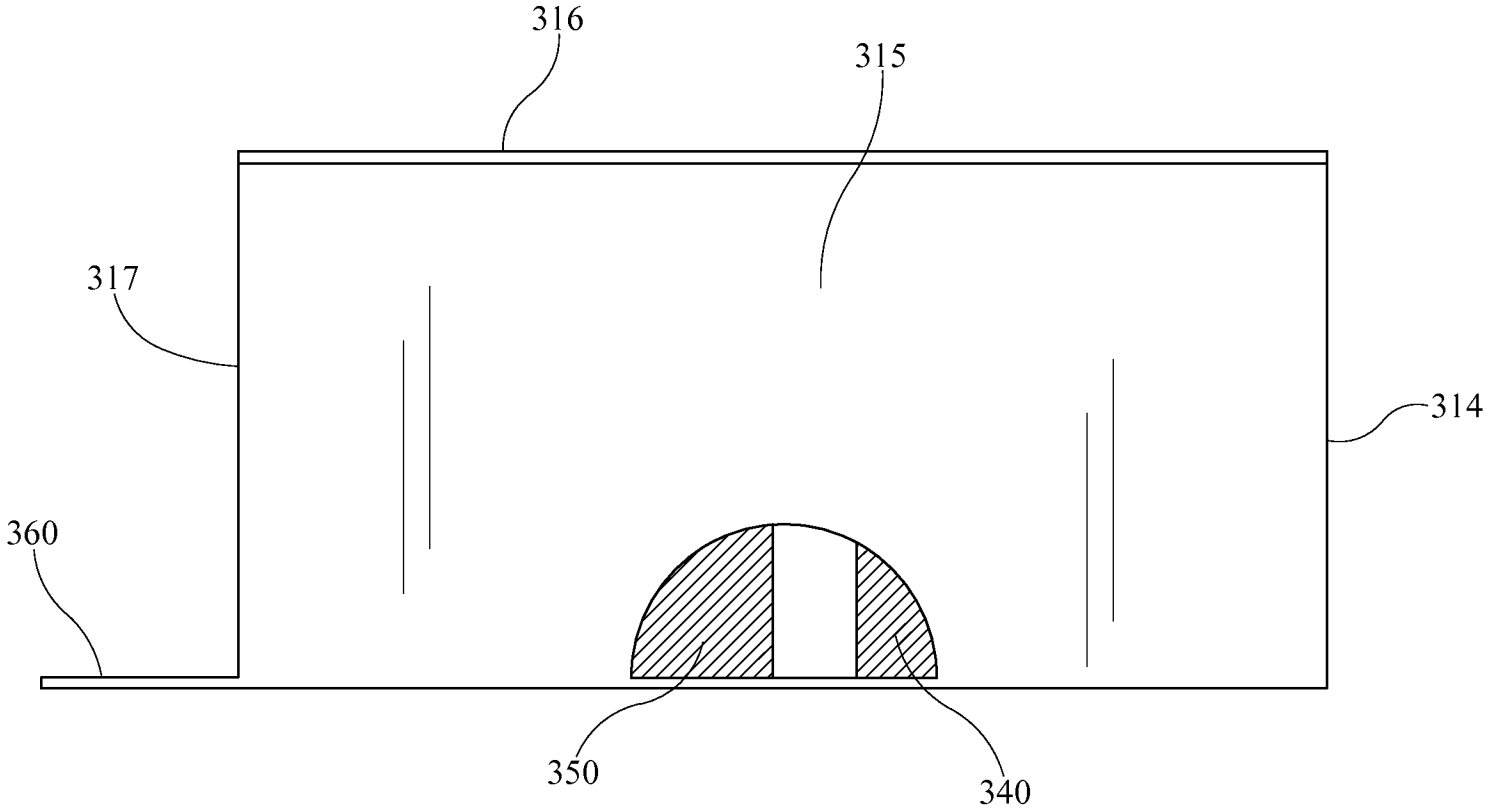
FIG. 12 is a side view of the emergency lamp module of FIG. 9.
Figure 13:
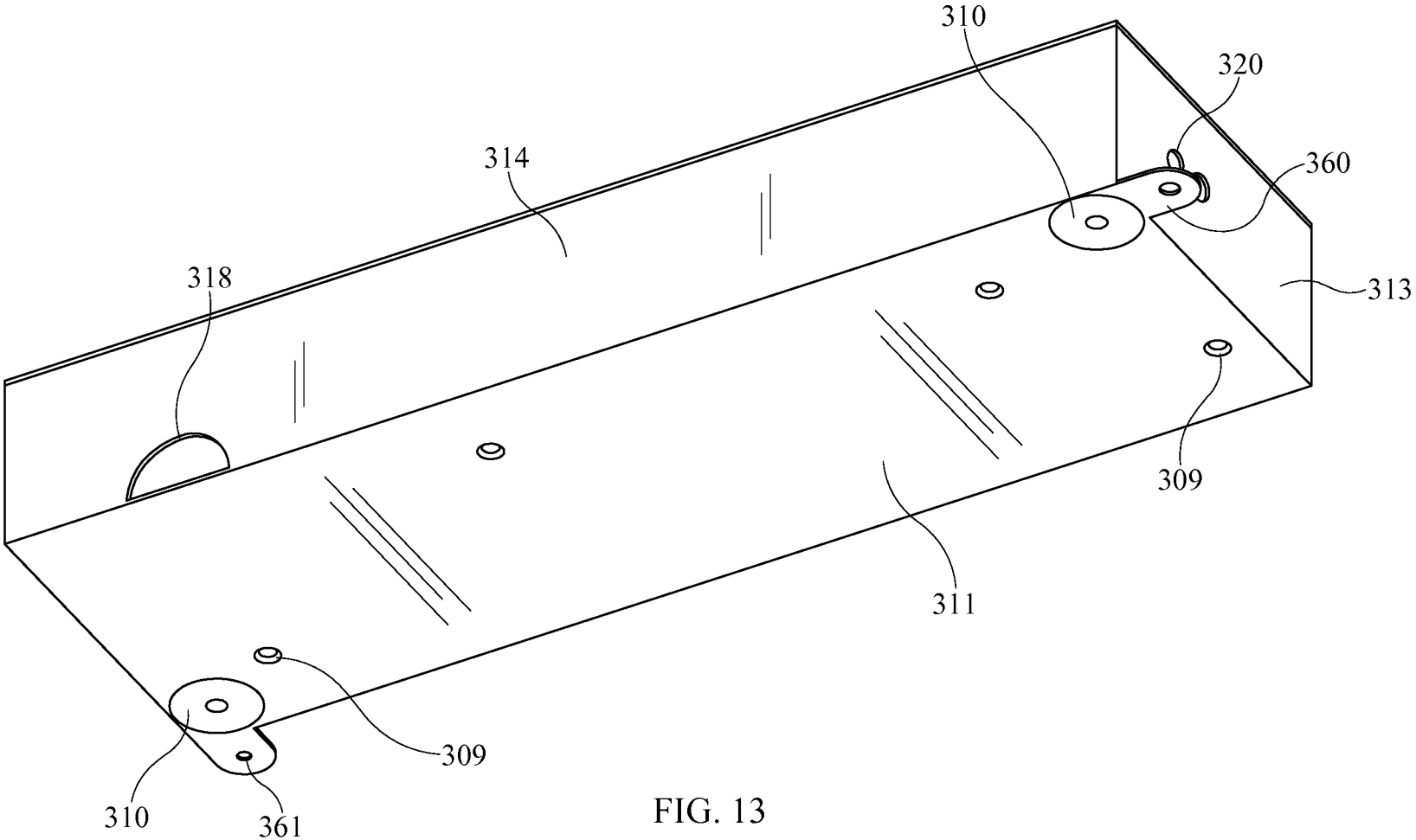
FIG. 13 is a lower perspective view of the emergency lamp module of FIG. 9.
Figure 14:
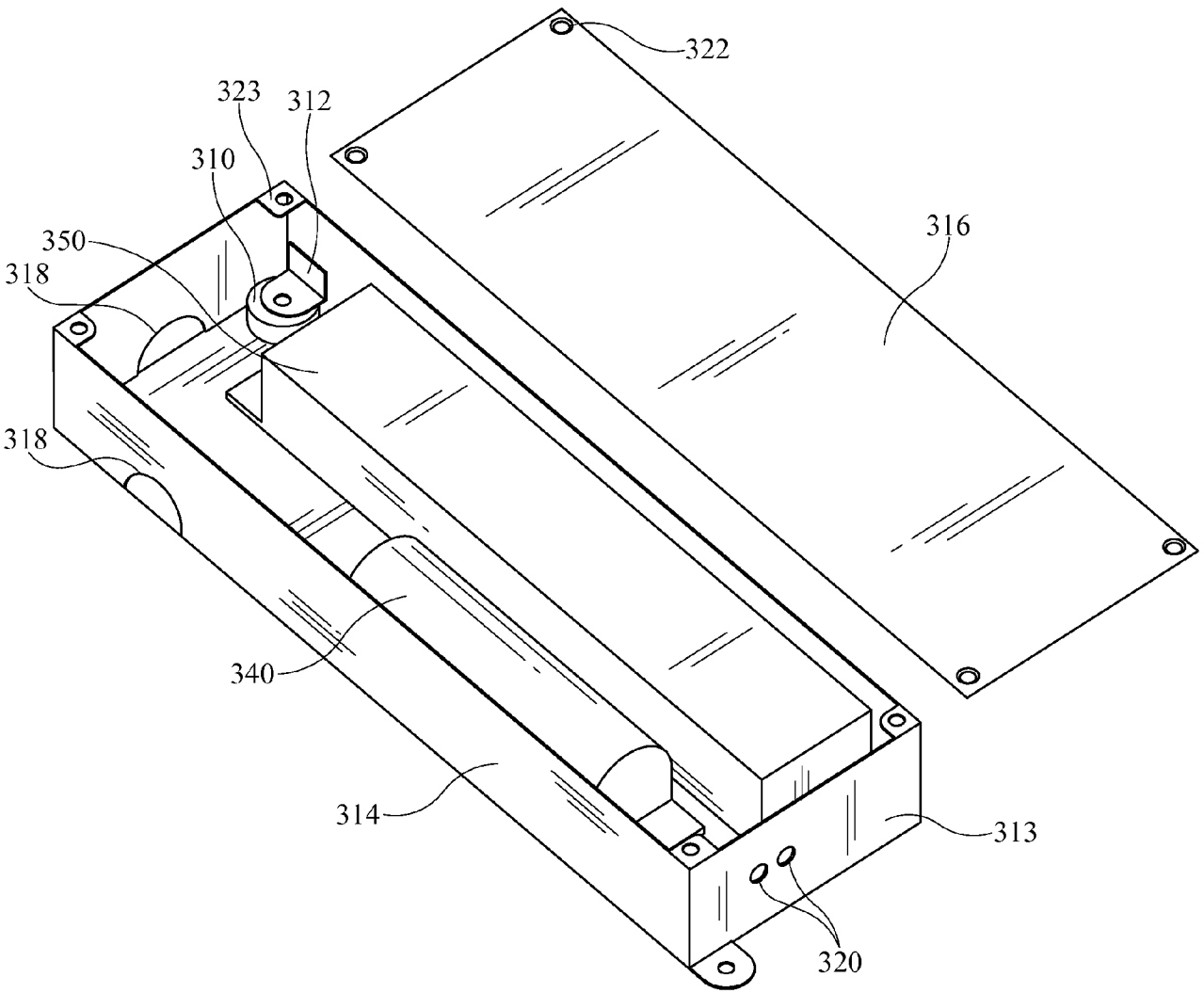
FIG. 14 is an upper perspective view of the emergency lamp module of FIG. 9 having a bottom wall removed.

FIGS. 7 and 8 show lower and upper perspective views of an electrical junction box 200 of the present disclosure. Electrical junction box 200 is configured to cover the junction between an electrical connector, or electrical wire and connector 140, and existing power supply wiring in a lamp fixture being retrofitted. Electrical junction box 200 has sidewalls 212 depending from top wall 216. End walls 214 extend between sidewalls 212 and depend from top wall 216 to form a five walled junction box 200. One end wall 214 has junction box cavity 218 configured and disposed for extending electrical wires from the lamp fixture being retrofitted, power source, and to LED retrofit system 100 of the present disclosure. Electrical junction box 200 comprises at least one magnet 210 configured and disposed to hold electrical junction box 200 to the lamp fixture being retrofitted. For example, magnets 210 may be disposed in opposite corners of electrical junction box 200, along sidewalls 212 and/or end walls 214. Each magnet 210 has a surface in a plane with the edges of sidewalls 212 and the edges of end walls 214. Electrical junction box mechanical holders 260 may extend outwardly from side walls 212 and have an aperture 261 therein. Electrical junction box holders 260 are optional and may provide for additional and/or alternative holding of electrical junction box 200 to a surface of a light fixture being retrofitted.

In at least one embodiment of the LED retrofit system of the present disclosure, the system comprises at least one longitudinally extending LED lamp 130 having a length substantially greater than a width and open longitudinal ends 137. It is to be understood that the LED retrofit system of the present disclosure may comprise one, two, three, or more longitudinally extending LED lamps 130. For example, aspects of the LED retrofit system of the present disclosure may comprise four, five, six, eight, twelve, or more LED lamps 130. In at least one aspect, LED retrofit system 100 comprises an equivalent number of LED lamps 130 as the fluorescent lamps in a lamp fixture being retrofitted.

First and second LED lamp support rails, 120 and 125, are configured to hold and cover open longitudinal ends of each longitudinally extending LED lamp. First LED lamp support rail 120 is configured for the electrical connection of each longitudinally extending LED lamp with a power source or with electrical wire and connector 140. LED retrofit system 100 comprises a system holder on each LED lamp support rail configured and disposed to hold the retrofit system to a portion of a lamp fixture being retrofitted. The system holder may comprise apertures in each LED lamp support rail for receiving fasteners. Alternatively or additionally, the system holder may comprise magnets disposed with each LED support rail. The LED lamp retrofit system of the present disclosure may comprise other and/or additional holders or fasteners as are known by persons having ordinary skill in the art.

In at least one aspect of the LED retrofit system of the present disclosure, each system holder comprises at least one magnet 110 on first LED lamp support rail 120 and at least one magnet 110 on the second LED lamp support rail 125, wherein the magnets 110 are configured and disposed to hold the retrofit system to a portion of a lamp fixture being retrofitted. Alternatively, or additionally, each of the first and second support rails 120 and 125 may comprise apertures in a portion thereof to be placed adjacent a troffer of the fluorescent lamp fixture being retrofitted. Each of the apertures may be configured and disposed to receive a fastener, such as a screw, for fastening LED retrofit system 100 to the fluorescent lamp fixture being retrofitted.

LED lamps 130 may have an optical and visual outlook substantially similar to that of one or more fluorescent lamps to be removed from the lamp fixture to be retrofitted. LED retrofit system 100 may comprise one or more longitudinally extending LED lamps 130 having a longitudinally extending array of LEDs with power inputs extending out of the first open longitudinal end configured and disposed to electrically connect to a power source. First and second open longitudinal ends of each LED lamp 130 may comprise female helical threads configured and disposed to threadingly engage with fasteners for holding and covering the open ends with the first and second lamp support rails, 120 and 125.

LED retrofit system 100 may comprise an electrical junction box 200 configured to cover an electrical junction between LED retrofit system 100 and existing electrical wiring in the lamp fixture being retrofitted. In at least one embodiment, electrical junction box 200 may be a cover 200. Cover 200 may be configured to cover an electrical junction or component parts of an electrical system and may comprise at least one magnet configured and disposed to hold the cover in place. For example, cover 200 may be an electrical junction box configured to magnetically attach to a portion of an electrical system and cover an electrical junction between the electrical system and a power source. Cover 200 may be configured to cover an electrical junction in a lighting system or component parts of the lighting system and may comprise at least one magnet configured and disposed to hold cover to a portion of the lighting system. Electrical junction box 200 may comprise at least one magnet 210 configured and disposed to hold electrical junction box 200 to a lighting system being retrofitted.

Cover 200 may comprise a sole rounded or semi-spherical wall or may be rectangular in shape. For example, cover 200 may comprise a top wall 216, a first sidewall 212 extending from the top wall, a second sidewall 214 extending from the top wall and the first sidewall, a third sidewall 212 extending from the top wall and the second sidewall, and a fourth sidewall 214 extending from the top wall, the first sidewall and the third sidewall. Cover 200 may comprise at least one magnet 210 held with the first sidewall, second sidewall, third sidewall, fourth sidewall, or top wall and may be configured to hold the cover to a ferromagnetic surface. For example, the at least one magnet may be configured and disposed to hold cover 200 to a lighting system troffer.

Cover 200 may have a surface of the at least one magnet 210 substantially in a plane with an outer edge of one of the sidewalls. Cover 200 may further comprise at least one mechanical holding device 260. For example, a mechanical holding device 260 may comprise at least one flange extending from a sidewall in a substantially common plane with an outer surface of the at least one magnet 210, wherein each flange may have an aperture 261 configured to receive a fastener.

In at least one embodiment, cover 200 is an electrical junction box configured to cover an electrical junction between a lighting system and a power source and the at least one magnet 210 may be configured and disposed to hold the electrical junction box to the lighting system. In at least one other embodiment, cover 200 may comprise at least two of the magnets 210, wherein each of the magnets is held proximate a different sidewall. Each of the at least one magnet 210 may be held with an inner surface of cover 200. One of the sidewalls, 212 or 214, may have at least one cavity 218. Cavity 218 may be configured to receive power lines.

It is to be understood that even though cover 200 is herein described as having four sidewalls and a top wall, cover 200 may comprise a sole wall. For example, cover 200 may comprise a sole rounded or spherical wall. Cover 200 may be configured to cover component parts of an emergency lamp module of a lighting system. For example, cover 200 may be configured to cover and/or hold component parts of an emergency lamp module. An emergency lamp module may comprise an emergency module and a battery, which may be configured to supply power to a lighting system in the event of a disruption in supplied power from a power source.

FIGS. 9-14 show emergency lamp module 300. Emergency lamp module 300 comprises an emergency module 350 and a battery 340 held within a housing. The housing may comprise a top wall 311, a first sidewall 313 extending from top wall 311, a second sidewall 314 extending from top wall 311 and first sidewall 313, a third sidewall 315 extending from top wall 311 and second sidewall 314, and a fourth sidewall 317 extending from top wall 311, first sidewall 313 and third sidewall 315.

Emergency lamp module 300 may further comprise bottom wall 316 which may be removably held to the sidewalls. For example, bottom wall 316 may comprise portions of a fastener 322 proximate its corners. Other fastener portions 323 may be disposed proximate corners of the sidewalls. Fastener portions 322 and 323 may be configured to removably fasten with each other to provide a removable bottom wall 316. Bottom wall 311 may comprise one or more apertures 309.

Emergency lamp module 300 comprises at least one magnet 310 and configured to be magnetically held to a portion of a lighting system and to supply power to the lighting system in the event of a disruption in supplied power from a power source. The at least one magnet 310 may have a surface substantially in a plane with an outer edge of emergency lamp module 300. Each magnet 310 may be held within the sidewalls with a magnet holder 312.

Emergency lamp module 300 may further comprise at least one mechanical holding device 360. Mechanical holding device 360 may comprise a flange extending outwardly from emergency lamp module 300 and in a substantially common plane with the outer surface of the at least one magnet 310, wherein each flange has an aperture 361 configured to receive a fastener. Each magnet 310 may be held with the first 313, second 314, third 315, fourth 317 sidewall, or top wall 311 and magnets 310 may be configured to hold emergency lamp module 300 to a troffer.

One of the sidewalls, 313, 314, 315, or 317 may have at least one cavity 318. Cavity 318 may be configured to receive power lines. One of the sidewalls, 313, 314, 315, or 317 may comprise apertures or electrical connectors 320, configured to electrically connect battery 340 and/or emergency module 350 with an external power source.

In at least one other aspect of the present disclosure, an LED retrofit kit is provided. The LED retrofit kit may comprise a first LED lamp support rail 120 configured to hold and cover a first longitudinal open end 137 of at least one longitudinally extending LED lamp 130 and to electrically connect each of the at least one longitudinally extending LED lamps 130 to a power source. A second LED lamp support rail 125 may also be provided and may be configured to hold and cover a second longitudinal open end 137 of each of the at least one longitudinally extending LED lamps 130 held with the first LED lamp support rail 120. First and second LED lamp support rails 120 and 125 may have similar configurations. At least one magnet 110 may be on the first LED lamp support rail 120 and at least one magnet 110 may be on the second LED support rail 125, wherein magnets 110 may be configured and disposed to hold the retrofit kit to a portion of a lamp fixture being retrofitted.

The LED retrofit kit may also comprise one, two, three, or more longitudinally extending LED lamps 130 having a length substantially greater than a width and open longitudinal ends. Longitudinally extending LED lamp 130 may have an optical and visual outlook substantially similar to that of one or more fluorescent lamps to be removed from a lamp fixture to be retrofitted. LED lamp 130 may comprise a longitudinally extending array of LEDs with power inputs extending out of one of the open longitudinal ends configured and disposed to electrically connect to a power source. Both open longitudinal ends of longitudinally extending LED lamp 130 may comprise female helical threads configured and disposed to cooperate with fasteners for holding and covering the open ends with the first and second lamp support rails.

First and second LED lamp support rails, 120 and 125, may also comprise at least one mechanical holding device configured and disposed to mechanically hold the retrofit kit to a portion of a lamp fixture being retrofitted. For example, in at least one aspect of the LED retrofit kit of the present disclosure, each mechanical holding device comprises an aperture 161 in a flange 160 extending from each LED lamp support rail, 120 and 125, in a substantially common plane with an outer surface of magnets 110.

The LED retrofit kit may further comprise an electrical junction box 200 configured to cover a junction between the retrofit kit and existing electrical wiring in the lamp fixture being retrofitted. The electrical junction box may comprise at least one magnet 210 configured and disposed to hold the electrical junction box to the lamp fixture being retrofitted.

In at least one additional aspect of the present disclosure, a method of retrofitting a fluorescent lamp fixture with at least one LED lamp is provided. The method comprises the steps of turning off the power to the fluorescent lamp fixture being retrofitted and accessing the fluorescent lamps in fluorescent lamp fixture. Removal of a cover or light reflector or refractor may need be performed to access the fluorescent lamps. Upon accessing the fluorescent lamps, the fluorescent lamps are removed from the fluorescent lamp fixture. Then a ballast cover is removed from the fluorescent lamp fixture and wires leading to and from a ballast, in the fluorescent lamp fixture, are cut. The ballast may then be removed from the fluorescent lamp fixture. An electrical connector may then be attached to the cut wire leading to a power source.

The method further comprises assembling a retrofit system. The retrofit system may be assembled by placing a first LED lamp support rail on a substantially flat surface. A second LED lamp support rail may be placed on the substantially flat surface and in a substantially parallel orientation with the first LED lamp support rail. A first end of at least one longitudinally extending LED lamp may be connected and held with the first LED lamp support rail and a second end of each longitudinally extending LED lamp may be connected and held with the second LED lamp support rail. Each connected and held longitudinally extending LED lamp may be electrically connected with a power lead wire. The assembled retrofit system may then be magnetically attached to a central portion of a troffer box cavity of the fluorescent lamp fixture being retrofitted. An electrical junction may then be made between the first end of each of the at least one longitudinally extending LED lamps and the cut wires extending into the troffer box. The power to the LED lamp retrofitted fluorescent lamp fixture may then be turned on.

The method of retrofitting a fluorescent lamp fixture with at least one LED lamp may further comprise a step of covering the electrical junction between the retrofit system and power source with an electrical junction box by magnetically attaching an electrical junction box to the troffer box cavity of the fluorescent lamp fixture being retrofitted. The method may further comprise fastening the assembled retrofit system to the central portion of the troffer box cavity of the fluorescent lamp fixture being retrofitted with fasteners extending through apertures in the first and second LED lamp support rails.

Aspects of the LED retrofit system, kit, and/or method of the present disclosure may have additional features or capabilities. For example, the LED retrofit system may be configured to operate using AC or DC power. The presently disclosed system may provide for dimming of one or more of the LED lamps. The system may be a multi-channel which may allow one or more LED lamps to be powered independent of other LED lamps in the LED retrofit system. One or more of the LED lamps may have its energy transmissible cover positioned upward and one or more of the LED lamps may have its energy transmissible cover positioned downward, allowing for up light and down light from a single LED retrofit system, which may be desired in some applications, such as high bay or sign applications for example. Aspects of the LED retrofit system may have multicolored LED lamps which may provide for color changing applications. In as least one aspect of the present disclosure, battery backup units may be provided for emergency operation such as in the event of a power failure.

Nomenclature

| | |
|---|---|
| Retrofit system | 100 |
| Magnet | 110 |
| LED lamp holder and end cover | 112 |
| LED lamp support rail fastening leg | 114 |
| LED lamp support rail extension | 116 |
| First LED lamp support rail | 120 |
| Second LED lamp support rail | 125 |
| LED lamp | 130 |
| Fastener | 132 |
| Fastener aperture | 133 |
| Wiring aperture | 134 |
| Female helical threads | 135 |
| Heat sink | 136 |
| Open longitudinal end of LED lamp | 137 |
| LED lamp energy transmissible cover | 138 |
| Electrical wire and connector | 140 |
| LED substrate | 142 |
| LED | 144 |
| LED power wires | 146 |
| Electrical wire cover | 150 |
| Electrical wire cover sidewall | 152 |
| Electrical wire cover end wall | 154 |
| Electrical wire cover top wall | 156 |
| Electrical wire cover mechanical holder | 158 |
| Electrical wire cover holder aperture | 159 |
| Mechanical holding device | 160 |
| Mechanical holding aperture | 161 |
| Supports | 168 |
| Electrical junction box | 200 |
| Magnet | 210 |
| Electrical junction box sidewall | 212 |
| Electrical junction box end wall | 214 |
| Electrical junction box top wall | 216 |
| Electrical junction box end wall cavity | 218 |
| Electrical junction box mechanical holder | 260 |
| Electrical junction box holder aperture | 261 |

The invention claimed is:

1. A cover comprising a top wall, a first sidewall extending from the top wall, a second sidewall extending from the top wall and the first sidewall, a third sidewall extending from the top wall and the second sidewall, and a fourth sidewall extending from the top wall, the first sidewall and the third sidewall, the cover being configured to cover an electrical junction or component parts of an electrical system and comprising at least one magnet configured and disposed to hold the cover in place.

2. The cover of claim 1, wherein the at least one magnet is held with the first sidewall, the second sidewall, the third sidewall, the fourth sidewall, or the top wall and is configured to hold the cover to the electrical system.

3. The cover of claim 2, wherein the at least one magnet has a surface in a plane with an outer edge of one of the sidewalls.

4. The cover of claim 1 further comprising at least one mechanical holding device.

5. The cover of claim 4, wherein each mechanical holding device comprises at least one flange extending outwardly from the cover in a substantially common plane with an outer surface of the at least one magnet, wherein each flange has an aperture configured to receive a fastener.

6. The cover of claim 1, wherein the electrical system is a lighting system having a troffer and the cover is an electrical junction box configured to cover an electrical junction between the lighting system and a power source, the at least one magnet being configured and disposed to hold the electrical junction box to the troffer.

7. The cover of claim 1 comprising at least two of the magnets, wherein each of the magnets is held substantially equidistantly within the cover.

8. The cover of claim 1 further comprising a cavity configured to receive power lines.

9. The cover of claim 1, wherein the electrical system is a lighting system and the cover is configured to cover component parts of an emergency lamp module.

10. The cover of claim 9, wherein the cover is an emergency lamp module comprising and holding an emergency module and a battery, the emergency module and battery are held with an inner surface of the cover, the emergency lamp module is configured to supply power to the lighting system in the event of a disruption in supplied power from a power source.

11. An electrical junction box comprising a cover configured to magnetically attach to a portion of an electrical system and cover an electrical junction between the electrical system and a power source, the cover having at least one magnet held therein, wherein each of the magnets has a surface substantially in a plane with an outer edge of the electrical junction box.

12. The electrical junction box claim 11 comprising at least one cavity configured to receive power lines.

13. The electrical junction box claim 11 further comprising at least one mechanical holding device.

14. The electrical junction box claim 13, wherein each mechanical holding device comprises at least one flange extending outwardly from the electrical junction box and in a substantially common plane with an outer surface of the at least one magnet, wherein each flange has an aperture configured to receive a fastener.

15. An emergency lamp module comprising an emergency module and a battery held within a housing, the emergency lamp module comprising at least one magnet and being configured to be magnetically held to a portion of a lighting system and to supply power to the lighting system in the event of a disruption in supplied power from a power source.

16. The emergency lamp module claim 15, wherein the housing comprises:

a top wall;

a first sidewall extending from the top wall;

a second sidewall extending from the top wall and the first sidewall;

a third sidewall extending from the top wall and the second sidewall;

a fourth sidewall extending from the top wall, the first sidewall and the third sidewall; and wherein the at least one magnet is held with the first sidewall, the second sidewall, the third sidewall, the fourth sidewall, or the top wall and is configured to hold the emergency lamp module to a troffer.

17. The emergency lamp module claim 15 comprising at least one magnet having a surface substantially in a plane with an outer surface of the emergency lamp module.

18. The emergency lamp module claim 17 further comprising at least one mechanical holding device.

19. The emergency lamp module claim 18, wherein each mechanical holding device comprises at least one flange extending outwardly from the emergency lamp module and in a substantially common plane with the outer surface of the at least one magnet, wherein each flange has an aperture configured to receive a fastener.

* * * * *